US006866722B2

(12) United States Patent
Snaza

(10) Patent No.: US 6,866,722 B2
(45) Date of Patent: Mar. 15, 2005

(54) SCREEN CLEANING DEVICE AND METHOD OF USING

(76) Inventor: Mark A. Snaza, 1451 Turquoise Dr., Carlsbad, CA (US) 92009

( * ) Notice: Subject to any disclaimer, the term of this patent is extended or adjusted under 35 U.S.C. 154(b) by 187 days.

(21) Appl. No.: 10/371,675

(22) Filed: Feb. 21, 2003

(65) Prior Publication Data

US 2004/0163672 A1 Aug. 26, 2004

(51) Int. Cl.[7] ..... B08B 1/00

(52) U.S. Cl. ..... 134/6; 134/8; 134/26; 134/42; 15/104.93; 15/104.94; 15/208; 15/209.1; 15/210.1

(58) Field of Search ..... 15/104.93, 104.94, 15/208, 209.1, 210.1; 134/6, 8, 26, 42

(56) References Cited

U.S. PATENT DOCUMENTS 2,838,777 A * 6/1958 Schoenfield et al. ..... 15/27
3,855,658 A * 12/1974 Ford ..... 15/77
6,375,755 B1 * 4/2002 Stuck ..... 134/6
2004/0163672 A1 * 8/2004 Snaza ..... 134/6

FOREIGN PATENT DOCUMENTS

JP 2002-0125893 * 5/2002

* cited by examiner

*Primary Examiner*—Sharidan Carrillo
(74) *Attorney, Agent, or Firm*—Gordon & Rees, LLP

(57) ABSTRACT

A screen cleaning tool including a thin sheet of fiberous material made by a process that includes the steps forming fibers into a lacy pattern, compressing the pattern into a thin sheet, applying a curable adhesive to the fibers, and curing the adhesive and pre-moistening said thin sheet with an aqueous solution of materials selected from the group consisting of propylene glycol, polysorbate, aloe extract, 2-phenoxyethanol, methyl paraben, butyl paraben, ethyl paraben, propyl paraben, isobutyl paraben, and DL-alpha-tocopheryl acetate in order to make it available to be wiped over the surface of a screen.

2 Claims, 2 Drawing Sheets

SCREEN CLEANING DEVICE AND METHOD OF USING

BACKGROUND OF THE INVENTION

1. Field of the Invention

This invention pertains to the cleaning industry. More particularly, it pertains to a unique product for wiping over screens, either in place or removed from their location, to remove dirt, dust, pollen, and other debris from the screen without destroying the product.

2. Description of the Prior Art

Window and door screens are in common use in many homes, apartments, condominiums, and the like, as well as in various areas in industry. Screens allow passage of air yet prevent entry of many undesirable elements such as birds, insects, blowing leaves, etc. Screens allow fresh air to enter a dwelling to blow away the stale and/or particle-laden air inside the dwelling that can be caused by smoking, pets, or quickly moving persons like children at play.

In industry, screens are widely used to prevent the inflow or outflow of large particulate material while allowing passage of air, gasses, and liquids that are involved in industrial applications ranging from coal burning to chemical preparation to air conditioning. Without screens, furniture, machines, and most importantly humans, would be subject to large amounts of particulate matter that could seriously affect the finish on the furniture, the smooth operation of the machine, and the health of the person.

During operation, screens become coated with grime, dust, fibers, threads and other material that, while responsive to the needs to use the screen in the first place, requires cleaning to allow the screen to maintain their efficiency and strain more grime, dust, fibers, threads and other material from the passing fluid stream, be it liquid or gas.

The prior art has exhibited a number of methods of cleaning screens. One way is to remove them to a remote location and subject them to hosing with water cleaning liquid. This is often accompanied with a bare pre-brushing, a soapy water pre-brushing, or an after-scrubbing with a soapy solution. With larger screens, some are cleaned in place by blasts of compressed air, pressurized water, and, in some extreme cases, with pressurized flames. Further, screens many times have to be removed from their mounting, washed, dried, and remounted. Without removing the screens, some of the loosened debris, caught in the screen, may find its way into the house, into a machine or into one's lungs.

Cleaning screens in place has many disadvantages that have, heretofore, prevented many products from being employed. The biggest problem has to do with the rough surface of the screen itself. While brushes will dislodge debris from a mounted screen, the dislodged debris becomes air borne and will cause problems interior the area where the screen is mounted. Most mounted screens cannot be cleaned with a blast of air or water or flames, as aforesaid, and the screen must be de-mounted for this type of cleaning.

Cloths, rags, and paper wipes have not been found useful for a number of reasons. They degrade and fall apart when passed across the rough surface and the degradation adds to the debris already on the screen. Much of this type of cleaning results in more debris added to the screen or cloths and rags that are no longer useful for further cleaning or that require washing, to remove the debris, and repairing before later use on screens. Fiberous wipes, on the other hand, have heretofore not been found useful because they also degrade and fall apart when passed over the rough surface of the screen. Wetting the wipes has not been successful either as the mere act of wetting them begins the degrading process that allows them to fall apart before they become effective in cleaning the screen. Even spun fiber wipes, both wet and dry, have been found unusable in cleaning screens. In addition, using them requires such a large number of them to be used such that the overall process is not cost effective.

SUMMARY OF THE INVENTION

This invention is the discovery of a specific pre-moistened, fiberous wipe that does stand up to a process of cleaning a screen without falling apart and without leaving parts and pieces of debris behind, either from the debris already removed from the screen or debris from the fiberous wipe itself. The pre-moistened, fiberous wipe of this invention performs the cleaning process while the screen is kept in place or when the screen is removed for cleaning at a location apart from its normal situs. It is believed to be the only successful screen-cleaning, pre-moistened wipe because the fibers are constructed in a non-orthogonal pattern, i.e., instead of the fibers being cross-laid in a north-south/east-west direction, these fibers are formed in a lacy, spun pattern (called "spunlace") that, in essence, interlocks the fibers so that north-south rubbing, or east-west rubbing, on the screen surface does not dislodge the fibers from the wipe but allows the fibers to retain their interlocked construction throughout the entire cleaning process.

Accordingly, the main object of this invention is the discovery of a single, pre-moistened wipe that is usable for cleaning metal and plastic screens, either in-situ or after being removed from their mounting. Another object of this invention is a simple, inexpensive, pre-moistened wipe that will remove debris caught in a screen without itself degrading and breaking apart during the process of wiping the wipe over both sides of the screen.

These and other objects of the invention will become more clear when one reads the following specification, taken together with the drawings that are attached hereto. The scope of protection sought by the inventor may be gleaned from a fair reading of the claims that conclude this specification.

DESCRIPTION OF THE PREFERRED EMBODIMENT

Figure 1:
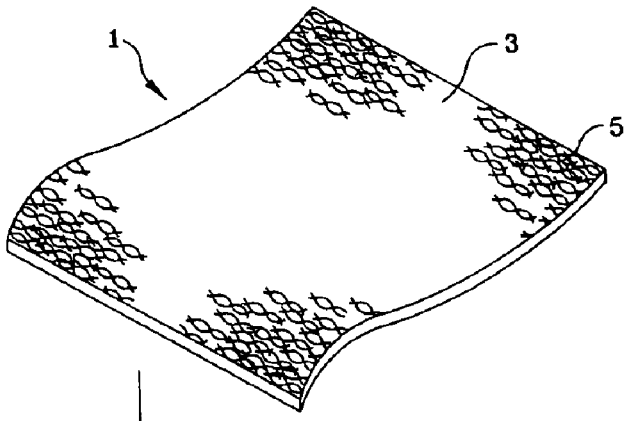
FIG. 1 is a perspective view of the thin sheet of fiberous material useable in this invention.

Turning now to the drawings, wherein elements are identified by numbers and like elements are identified by like numbers throughout the four figures, FIG. 1 shows the screen cleaning tool 1 of this invention to comprise a thin sheet 3 of fiberous material made by a process including the steps of spin-matting plastic-based fibers 5 into a thin layer that includes spraying them, in a variety of orientations, on a releasable substrate, over-spraying the sprayed layer with a curable adhesive, pressing the layer flat and holding it flat and under slight pressure while the curable adhesive is cured. This is a typical process by which wipes are manufactured except that the fibers are laid in north-south, east-west, orthogonal direction. Specifically, the type of plastic used in this invention is a polypropylene/polyethylene/cellulose/rayon blended fiber, which is a broader range of plastic than polyester/rayon fibers, and the fibers are subjected to a "spunlace" or spin-matting operation. Such a thin sheet 3 is preferably cut to the size of six inches by eight inches or eight by ten inches in rectangular shape for ease in using with one's hand.

Figure 2:
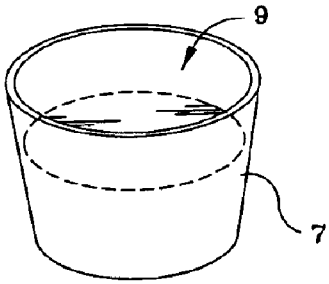
FIG. 2 is an illustrative view of a container holding a liquid for pre-moistening the fiberous material shown in FIG. 1.

FIG. 2 shows a container 7 holding a quantity of solution 9 for pre-moistening sheet 3. Solution 9 is an admixture of various materials. The preferred admixture contains an aqueous solution of materials selected from the group consisting of propylene glycol, polysorbate, aloe extract, 2-phenoxyethanol, methyl paraben, butyl paraben, ethyl paraben, propyl paraben, isobutyl paraben, and DL-alpha-tocopheryl acetate. Sheet 3 premoistened with the above solution 9 can be obtained from Diamond Wipes International, 320 West Clary Avenue, San Gabriel, Calif. 91776 under the name "Adult Wash Cloth".

Figure 3:
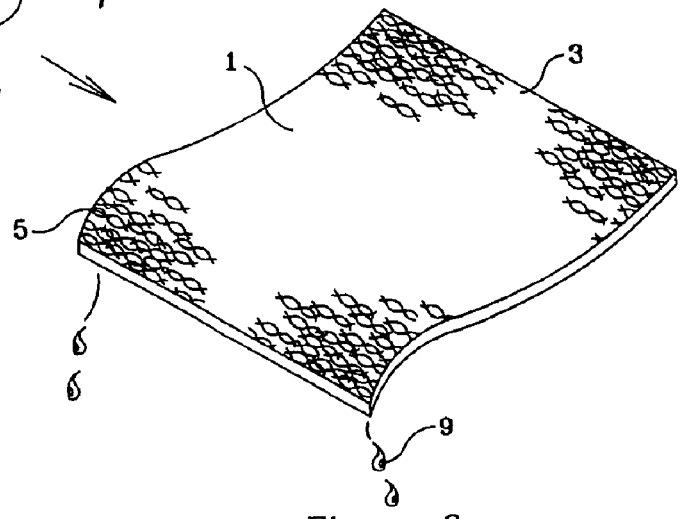
FIG. 3 is a perspective view of the thin sheet of fiberous material of this invention after being moistened with the liquid shown in FIG. 2.

As shown in FIG. 3, once moistened with solution 9, thin sheet 3 becomes screen cleaning tool 1 and is ready for use to clean screens. A plurality of pre-moistened screen cleaning tools 1 is then preferably stored in a re-sealable package (not shown) so that they can be used at a variety of screen locations over a period of time without drying out. Should tools 1 dry out, they can be re-moistened by pouring a small amount of solution 9 into the storage pack and closing the sealed lid to retain the liquid therein.

Figure 4:
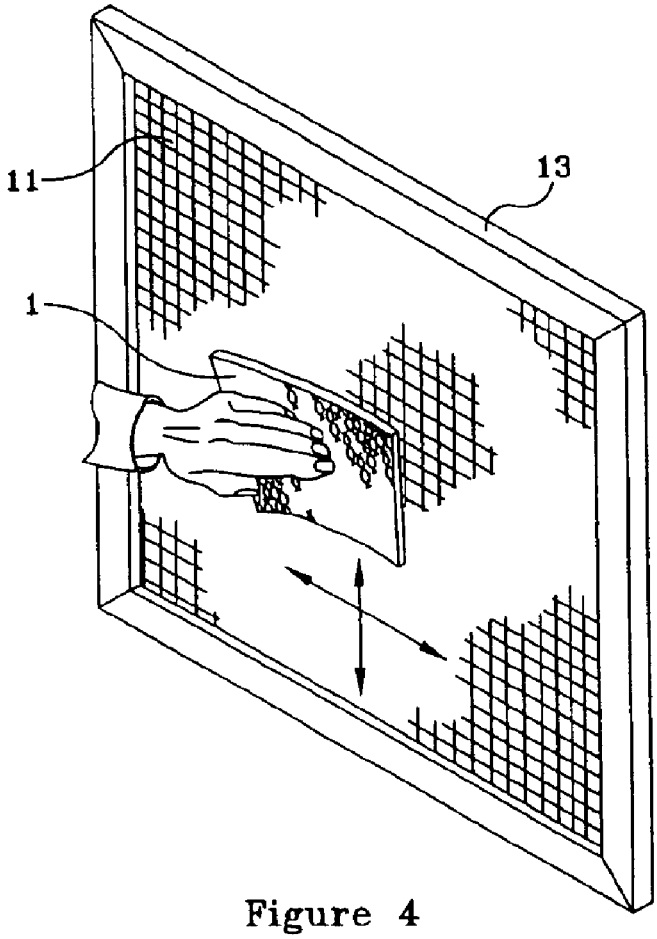
FIG. 4 is an illustrative view of a person using the pre-moistened fiberous material of this invention on a typical screen; and, FIG. 5 is a sectional view of a portion of an outer wall of a building showing the window well and a screen, mounted in a frame, set in the window well.

The process of using screen cleaning tool 1 to clean screens is shown in part in FIG. 4 and includes the steps of first obtaining one or more thin sheets 3 of fiberous material, as aforesaid, pre-moistening them with aqueous solution 9, to form screen cleaning tool 1, and then wiping the screen cleaning tool 1 over one side of a screen 11 to remove the debris collected thereon. When the first side of screen 11 has been cleaned with tool 1, and if there remains some areas of tool 1 that have not been used to wipe over the first side of screen 11, then the same tool 1 can be used to begin cleaning the other side of screen 11. If tool 1 has been fully used to clean one side of the screen 11, then new, tools 1 (wipes) need to be obtained and used to clean the opposite side of screen 11.

Tool 1 will remove dust, dirt, cat and dog hair, oil and grease, sea salt, and other fibers that get caught in the screen, all without degrading. No other pre-moistened fiber sheet is useful to clean screen because they all degrade, crumble, clog the screen pores with degraded material and do not clean the screen. When completed, tool 1 is merely discarded in the trash.

Figure 5:
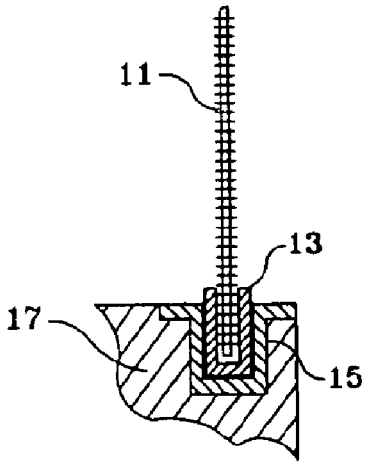

Often, screens 11 are mounted in frames 13 that are, themselves, mounted in a window well 15, located in the outer wall 17 of a typical house, as shown in FIG. 5, and in other holders that include a slot for the frame. In these situations, it may be desirable to temporarily remove screen 11, and its frame 13, from window well 15 in order to clean the debris that has fallen or been blown by wind from screen 11 into well 15. In this situation, screen 11 can be cleaned, when positioned on a horizontal surface, with tool 1. In addition, tool 1 can be folded up into a thicker mat and a portion thereof inserted into well 15 and moved therealong to remove debris that has migrated from the screen into the window well. The cleaned screen can then be re-assembled with its frame into the cleaned window well.

While the invention has been described with reference to a particular embodiment, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. The process of cleaning debris from a screen, mounted in a frame and set in a window well, comprising the steps of:

a) removing the screen and its frame from the window well and positioning it flat on a horizontal surface;

b) obtaining a sheet of fibrous material made by forming fibers into a lacy pattern, compressing the pattern into a sheet, applying a curable adhesive to the fibers, and curing the adhesive;

c) pre-moistening said sheet with an aqueous solution selected from the group consisting of propylene glycol, polysorbate, aloe extract, 2-phenoxyethanol, methyl paraben, butyl paraben, ethyl paraben, propyl paraben, isobutyl paraben, and DL-alpha-tocopheryl acetate;

d) wiping said pre-moistened sheet over one side of the screen to remove debris collected thereon;

e) turning the screen over on the horizontal surface and wiping said pre-moistened sheet over the other side of the screen to remove debris collected thereon;

f) folding said pre-moistened sheet into a thicker layer and inserting a portion of it into the window well and moving it there along to remove debris that has migrated into the window well; and g) re-assembling the cleaned screen and its frame into the cleaned window well.

2. The process of cleaning debris from a screen, mounted in a frame and set in a window well, comprising the steps of:

a) removing the screen and its frame from the window well and positioning it flat on a horizontal surface;

b) obtaining a sheet of fibrous material made by forming fibers selected from the group consisting of polypropylene, polyethylene, cellulose, and rayon, into a lacy pattern, compressing the pattern into a sheet, applying a curable adhesive to the fibers, and curing the adhesive;

c) pre-moistening said sheet with an aqueous solution selected from the group consisting of propylene glycol, polysorbate, aloe extract, 2-phenoxyethanol, methyl paraben, butyl paraben, ethyl paraben, propyl paraben, isobutyl paraben, and DL-alpha-tocopheryl acetate;

d) wiping said pre-moistened sheet over one side of the screen to remove debris collected thereon;

e) turning the screen over on the horizontal surface and wiping said pre-moistened sheet over the other side of the screen to remove debris collected thereon;

f) folding said pre-moistened sheet into a thicker layer and inserting a portion of it into the window well and moving it there along to remove debris that has migrated into the window well; and g) re-assembling the cleaned screen and its frame into the cleaned window well.

* * * * *